US005177818A

United States Patent [19]

Tsai

[11] Patent Number: 5,177,818

[45] Date of Patent: Jan. 12, 1993

[54] TOILET-SEAT FLUSH-VALVE OPERATING DEVICE

[76] Inventor: Wei C. Tsai, Room 5, 2F, No.80, Ho Ping West Rd., Sec. 1, Taipei, Taiwan

[21] Appl. No.: 685,892

[22] Filed: Apr. 16, 1991

[51] Int. Cl.[5] ..... E03D 5/04; A47K 13/10

[52] U.S. Cl. ..... 4/241; 4/250; 4/246.2

[58] Field of Search ..... 4/241, 248, 249, 250, 4/251

[56] References Cited

U.S. PATENT DOCUMENTS

| | | | |
|---|---|---|---|
| 481,498 | 8/1892 | Kremelberg | 4/250 X |
| 1,277,275 | 8/1918 | Vogel | 4/249 X |
| 1,605,939 | 11/1926 | Haas | 4/250 X |
| 1,821,027 | 9/1931 | Oya | 4/251 |
| 4,291,422 | 9/1981 | Shoemaker et al. | 4/251 |
| 4,338,690 | 7/1982 | Hsieh et al. | 4/251 X |
| 5,020,165 | 6/1991 | Huang | 4/251 |

FOREIGN PATENT DOCUMENTS

| | | | |
|---|---|---|---|
| 214186 | 10/1909 | Fed. Rep. of Germany | 4/251 |
| 271013 | 5/1928 | Italy | 4/249 |
| 256619 | 7/1927 | United Kingdom | 4/249 |
| 9006715 | 6/1990 | World Int. Prop. O. | 4/251 |

*Primary Examiner*—Henry J. Recla

*Assistant Examiner*—Robert M. Fetsuga

*Attorney, Agent, or Firm*—Wenderoth, Lind & Ponack

[57] ABSTRACT

A toilet-seat flush-valve operating mechanism comprises two systems, a toilet-seat lifting system and a flush-valve opening system, both employing the fluid pressure as a source of power. A hydraulic cylinder having on the bottom a water inlet is mounted inside a toilet cistern. When a piston-cum-static weight located inside the cylinder moves under water pressure and reaches a position at the upper end of the cylinder, the toilet seat descends and covers the toilet bowl. This piston-cum-static weight, that is, the weight of the static weight, falls down under its own weight to the position at the lower end of the cylinder and, by means of a connecting unit, lifts up the toilet seat. Due to the piston-cum-static weight, which is in balance with and slightly heavier than the toilet seat, relatively low water pressure is sufficient to push the piston-cum-static weight to move upwardly, thus permitting the toilet seat to descend under its own weight. Next, the piston-cum-static weight reverses and descends under its own weight when the actuating fluid is cut off, and through the intermediary of the connecting unit raises the seat and simultaneously, by means of a suspension cord, a secondary static weight and a magnet open the flush valve.

12 Claims, 6 Drawing Sheets

TOILET-SEAT FLUSH-VALVE OPERATING DEVICE

Reference is given here to the applicant's prior U.S. application with Ser. No. 07/617,889 and filing date, Nov. 26, 1990 now abandoned.

BACKGROUND OF THE INVENTION

1) Field of the Invention

The present invention relates to a toilet-seat flush-valve operating mechanism and, more particularly, to a toilet seat lifting mechanism itself and its construction whereby it is capable of bringing into motion a conventional flushing valve. According to the invention, an easily available intermediary pressure, that is, a water supply pressure, is employed as the source of power. The mechanism is characterized in that an actuating water pressure is provided by the stamping of a control valve, which pushes a piston to ascend, thereby permitting the toilet seat to fall down. The ability to descend by the seat is by its own weight, and is not in any way assisted by the piston, and, on the contrary, the motion helps in the lifting up of the piston. From this it can be recognized that the performance of the idle stroke of the piston is aimed at converting energy of the actuating water into potential energy to be temporarily stored. During the descending stroke, this energy is withdrawn for use as the power to lift the toilet seat, while at the same time accompanying the action to open up the flushing valve.

2) State of the Prior Art

It is a common experience that in using a water closet the user has always to stoop the body to raise or lower the toilet seat before or after use and to press the handle to flush the bowl by hand. This is not only an unpleasant job but is also unhealthful, for in so doing, it often causes contamination to the hand by stains around the toilet seat and on the flush handle. The situation is particularly serious in the case of public conveniences, and there is thus a need for the provision of an efficient and safe mechanism for automatically raising and lowering a toilet seat, as well as for opening the flush valve to flush the toilet bowl.

In this aspect, there has now been found some relevant teachings in this direction. For instance, the Canadian Patent No. 1,054,306 to Liu discloses an electrically operated lid-lifting and flushing device for use with toilets. Such devices with motors, electrical means and switches are inconvenient and unsuitable for use in toilet rooms, where, since there is a need for frequent cleansing with water, there is thus a likelihood of shock accidents due to current leakage.

Attempts have also been directed to the utilization of hydraulic power to automatically control the raising and lowering of the toilet seat, as well as the flushing of the bowl. For example, U.S. Pat. No. 4,291,422 to Shoemaker et al. teaches a double-acting mechanism which employs four way control valves and a piston rod. This mechanism, with a complicated construction, is quite cumbersome, rendering its use highly undesirable.

The foregoing deficiencies in the prior art are overcome by the combined toilet-seat lifting and flush-valve opening mechanism of the present invention, which differs from the prior art in the provision of a single-acting piston-cum-static weight member for positively controlling the movement of the toilet seat at the complete discretion of the toilet user.

SUMMARY OF THE INVENTION

According to the present invention, a combined toilet-seat lifting and flush-valve opening mechanism is comprised of a toilet-seat lifting device which includes a hydraulic cylinder unit having thereinside a piston-cum-static weight capable of being lowered under its own weight and raised by water pressure, an operating lever unit mounted on the axis of the toilet seat, a unit connecting the piston-cum-static weight and the operating lever unit for passing by way of the latter the raising or lowering effect of the former on to the toilet seat, a foot-operated control valve and a pipeline located between the cylinder unit, the control valve unit, the cistern and the source of water supply. A flush-valve opening device includes a suspension cord suspended from guide pulleys fixed on a supporting frame of the cistern and having one end thereof connected to the piston-cum-static weight and the other end thereof tied to a secondary static weight to enable the secondary static weight to rise or fall along with the raising or lowering of the piston-cum-static weight. A known flush valve is pivotally connected to a supporting frame fixed at the bottom of the cistern. A stop lever extends oppositely from the pivoted portion of the flush valve and forms a single unit therewith. A magnet is mounted on the upper surface of the flush valve, a known flush-valve control stand is pivotally connected to the bottom of the cistern and a float is located on the control stand. The toilet-seat flush-valve operating device is constructed such that when the control valve unit is operated by a foot to control the flow in the pipeline, thereby permitting the pressure water supply (the actuating water) to pass from the lower end into the cylinder unit, the piston-cum-static weight is enabled, which is in slight balance with the toilet seat, to rise with a little water pressure and the toilet seat to fall down under its own weight and by itself and also by way of the connecting unit to cover on the toilet bowl. Next, when the control valve is released and the actuating water is cut off, water from under the piston-cum-static weight is able to escape through the bypass port to be released to the upper side of the piston-cum-static weight and from there to flow into the cistern, thereby permitting the piston-cum-static weight to descend by itself and also by the connecting unit to force the toilet seat to be pivotally lifted. The ascent of the piston also enables, through the suspension cord, the secondary static weight hanging on the other end of the cord to fall down to be eventually attracted to the magnet fixed on the flush valve so that, when the piston-cum-static weight next reverses to descend, it enables the flush valve to be hanged high and open.

BRIEF DESCRIPTION OF THE DRAWINGS

Other objects and features of the present invention will be clear form the accompanying drawings, in which.

DESCRIPTION OF A PREFERRED EMBODIMENT

Figure 1:
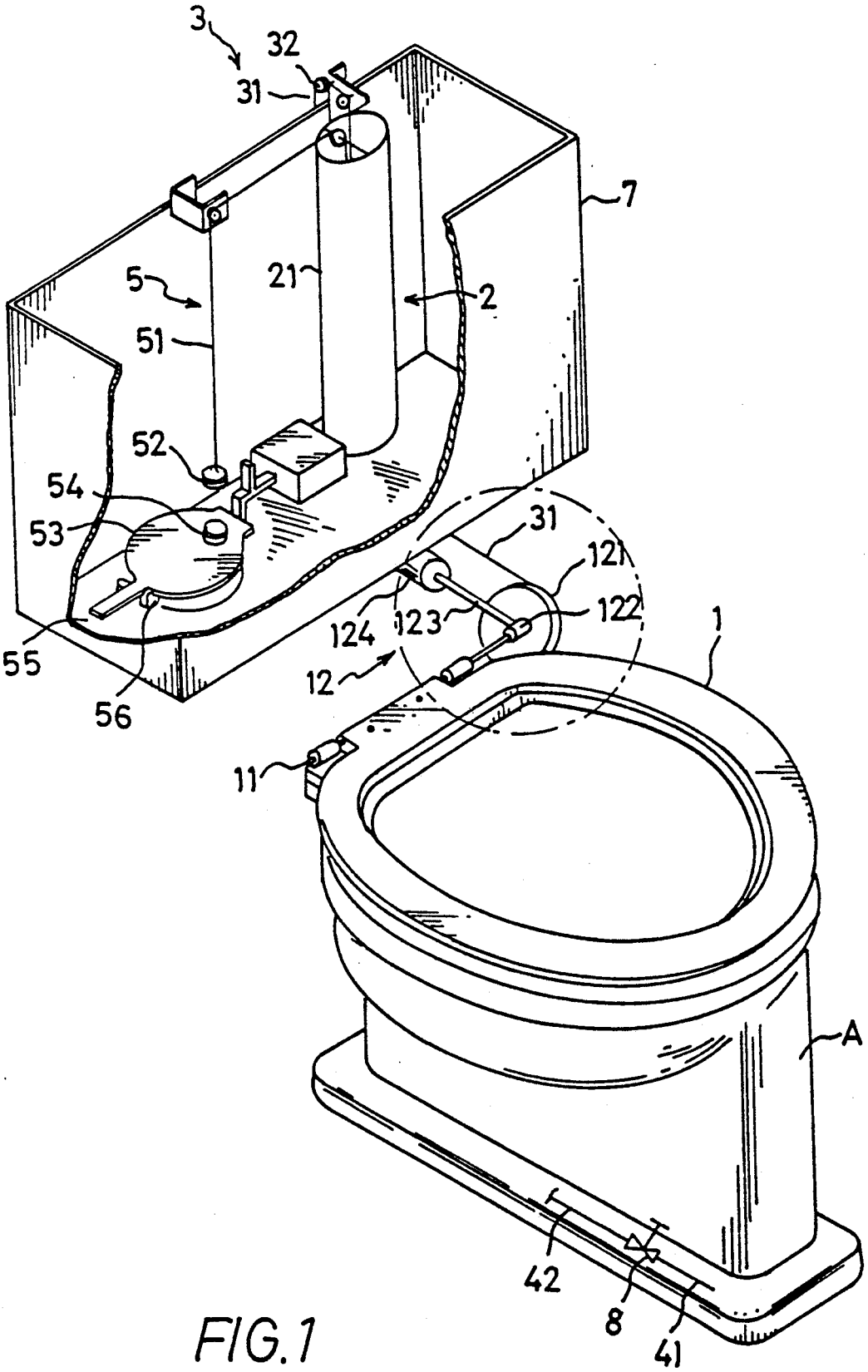
FIG. 1 is a perspective view in partial section of an embodiment of the water closet fitted with a combined toilet-seat lifting and flushing-valve opening device in accordance with the invention.

In order to describe in detail the embodiment of a toilet-seat flush-valve operating device of the present invention, it is necessary here to provide an account of the toilet-seat lifting mechanism before going into a description of the flush-valve opening mechanism. The construction of a toilet-seat lifting mechanism is as shown in the accompanying drawings, and comprises a hydraulic cylinder unit 2 provided inside a hydraulic cylinder 21 with a piston-cum-static weight 22, formed by combination of a piston and a static weight a connecting unit 3 and an operating lever unit 12. The piston-cum-static weight 22 is capable of being lifted up and lowered down inside the cylinder 21, the movement of which is transmitted by means of the connecting unit 3 and operating lever unit 12 to the toilet seat 1 of the water closet designated at A. The operating lever unit 12 is formed of a lever body 123, a wheel 121 and a static weight 124, and is fitted to the pivotal axis 11 of the toilet seat 1 by a setting pin 122. However, as shown in FIG. 1A, there may also be added on the side of the toilet seat a lever tip 125 opposite the lever body 123 to raise up the toilet seat 1 with the operating lever unit 12 being movably mounted on the axis 11. In the present embodiment, the lever body 123 and the toilet seat 1 form a straight line so that the cord 31 is connected to the operating wheel 121. If the two are not in a straight line but are offered with a suitable angle, this cord 31 may be attached to lever body 123, that is, the operating wheel 121 may be removed. Again, if the piston-cum-static weight 22 has the sufficient weight by itself and will not need a static weight 124 to share the static weight function, this static weight 124 may also be done away with, as shown in FIG. 1B. Following this arrangement, the axis 11 may be made in an L-shape, the hooked portion of which may be substituted for the lever body 123 so that the connecting cord 31 described hereinbelow can be directly connected to the axis 11. Depending on the need, it may be possible, therefore, to select one or two members from among the lever body 123, the operating wheel 121 and the static weight 124, or it may even be possible to omit the entire unit from the construction.

In FIG. 1A, the operating lever unit 12 is shown to be rotatably mounted on the straight pivotal axis 11, in which the arm 125 extends forward from the axis 11 and in the same direction, to be rested under the toilet seat 1. Following the descent of the piston-cum-static weight 22, this arm 125 functions to lift up the toilet seat 1 by the pulling force of the connecting cord 31, and when the piston-cum-static weight 22 rises in the opposite direction, the toilet seat 1 descends by its own weight. Next in FIG. 1B, as described above, the entire operating lever unit 12 has been omitted, the axis 11 is formed in an L-shape, and since it is to be pivotably immovable relative to the toilet seat 1, the axis 11 and a hole on the toilet seat 1 may be formed of a square or any shape in section according to a known technique. In the present embodiment, the axis 11 is fixed to the toilet seat 1 by setting pins 122, and when the toilet seat 1 covers flatly on top of the bowl, the hooked portion of axis 11 forms an approximately 45° angle with the connecting cord 31. The axis 11 is able to raise up the toilet seat 1 under the pulling force of the connecting cord 31 tied to the free end of the curved rod 112, and the toilet seat 1, as in the above, falls by its own weight. Again, in FIG. 1C, the axis 11, as shown, is formed of an axis body 111, a curved rod 112 and a support rod 113, and the axis 11 and the toilet seat 1 are mutually rotatable. The curved rod 112 is at its free end tied with the connecting cord 31, which forms an approximately 45° angle with the curved rod 112 of axis 11. This curved rod 112, under the pulling force of the cord 31, functions to lift up the toilet seat 1 through the support arm 113, and next the toilet seat 1 falls, as usual, by its own weight.

The connecting unit 3 is formed of a connecting cord 31 and a guide wheel 32. One end of the cord 31 is connected to the piston-cum-static weight 22 and the cord, after by-passing the guide wheel 32, may be connected, as described above, directly to the axis 11. However, in the present embodiment, the cord 31 is connected to the operating wheel 121. In place of the connecting lever unit 3 any other appropriate known means may be used.

Figure 2:
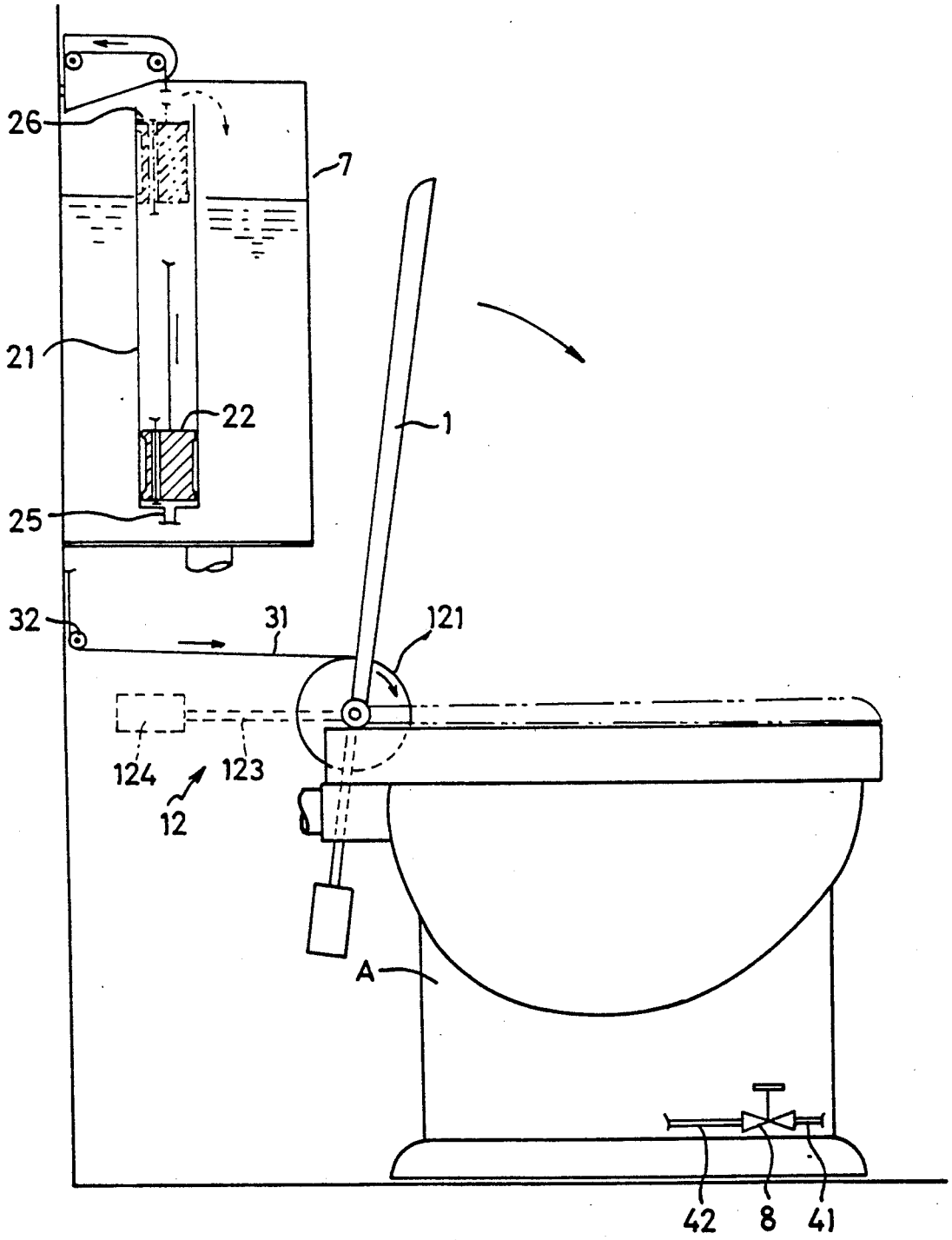
FIG. 2 is a side view of the water closet of FIG. 1, in partial longitudinal section, showing the toilet seat in the raised position.
Figure 6:
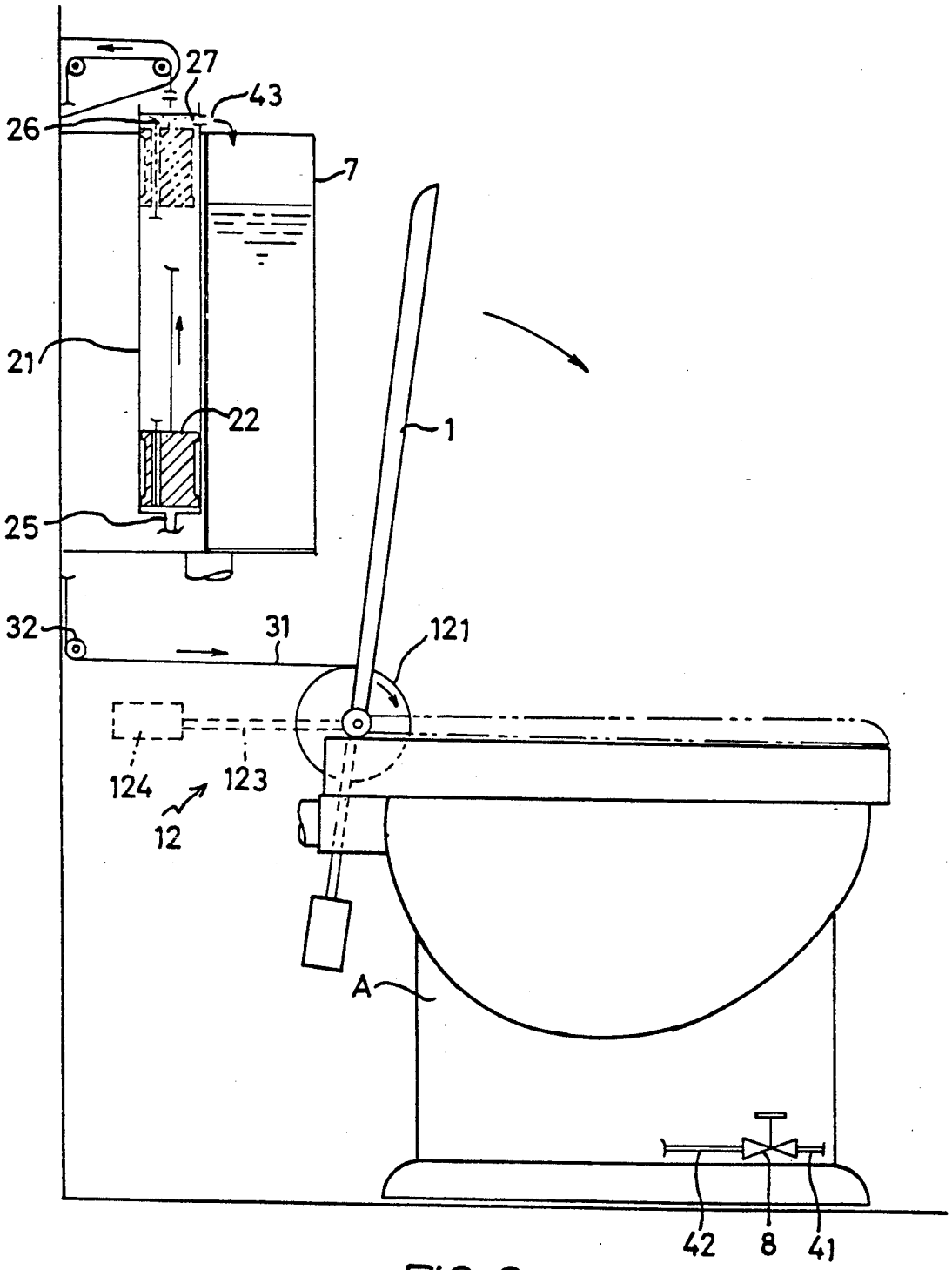
FIG. 6 is a side view of the water closet of FIG. 1, in partial longitudinal section, showing the toilet seat in the raised position and the hydraulic cylinder unit located outside of the cistern of the water closet.

A known control valve 8, which is foot-operated, is connected to the source of water supply by a pipeline 41. The water outlet end of the control valve 8 is joined by another pipeline 42 to an inlet port 25 on the bottom of the hydraulic cylinder 21. Next, when the hydraulic cylinder 21 is located outside the cistern 7 as shown in FIG. 6, to an outlet port 27 at the upper end of the hydraulic cylinder 21 is joined a pipe 43 for draining water into the cistern 7. This pipe 43 allows water that has accumulated on the top of the weight to pass into the cistern 7 as the piston-cum-static weight 22 rises. However, if the hydraulic cylinder 21 is located inside the cistern 7 as shown in FIG. 2, an outlet port 27 and pipe 43 can be omitted.

Since the aforesaid piston-cum-static weight 22 that is located inside the hydraulic cylinder 21 also has the function of a static weight, this piston 22 thus serves to keep about balance with the weight of the toilet seat 1. Being slightly heavier than the toilet seat 1 when a second static weight is not provided, the piston-cum-static weight 22 is able to rise up to the top with relatively low actuating water pressure, and further, with a functional ability to descend by its own weight, that is, the weight 22 has the potential energy to raise the toilet seat 1 while simultaneously being able to open up the flush valve, the detail of which will be dealt with later. Conversely, when the toilet seat 1 falls down by its own weight, it also helps pull the piston-cum-static weight 22 to rise up with the help of the connecting unit 3 and the actuating water. At the same time, being subjected to its own action, the toilet seat 1 falls slowly, whereby no impact noises are produced.

Figure 3:
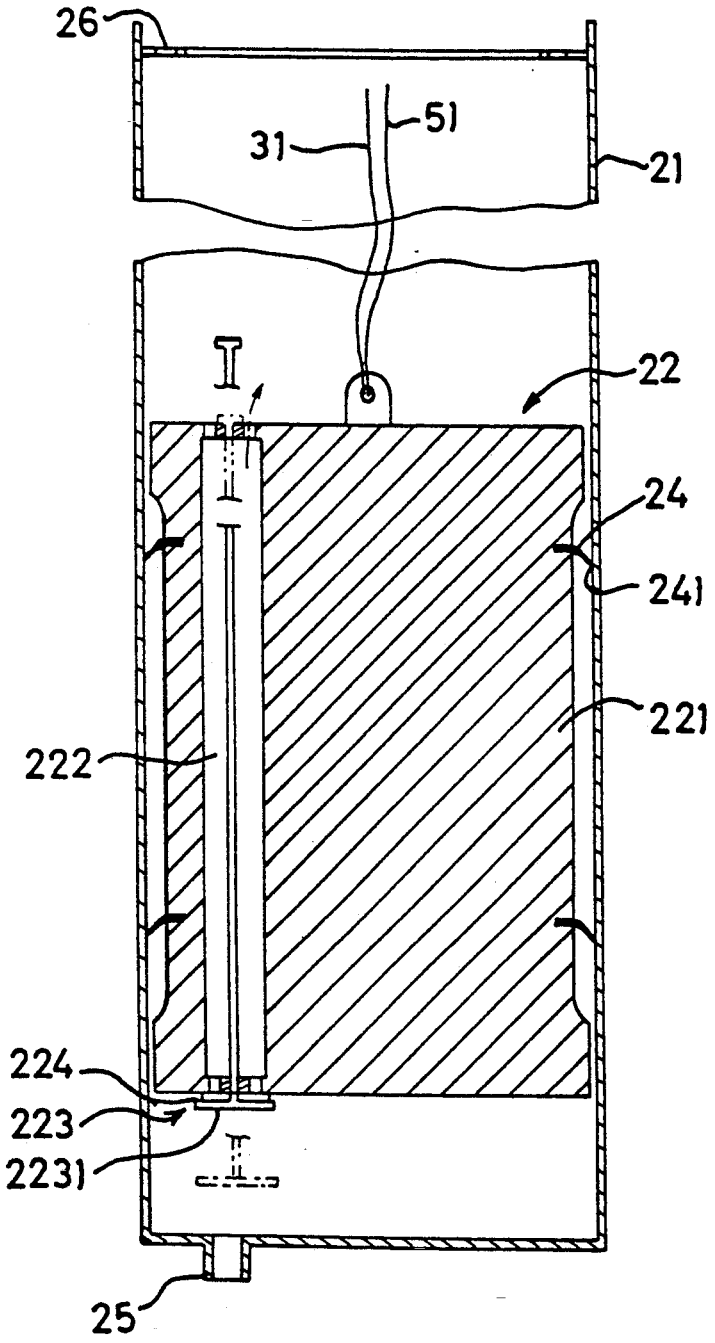
FIG. 3 is an enlarged longitudinal sectional view of the hydraulic cylinder unit located inside of the cistern of the water closet.

As shown in FIG. 3, the piston-cum-static weight 22 in the embodiment includes a main piston body 221 having a by-pass port 222, a by-pass valve 223 provided with an orifice 2231 for controlling the opening and closing of the by-pass port, and an outwardly and downwardly stretched cup-shaped piston ring 24 provided with an outer rim 241 to facilitate elastic sealing with the inner wall of the hydraulic cylinder 21 so that the piston-cum-static weight 22 is able to move smoothly vertically inside the cylinder. However, it will also serve if this piston ring 24 is of any other construction.

An account on the function and operation of the toilet-seat flush-valve operating device relative to the toilet-seat lifting and lowering part will now be given first as follows:

As shown in actual line in FIG. 2, the toilet seat 1 is held in the raised position and the piston-cum-static weight 22, which is slightly heavier than the toilet seat when a second static weight is not provided, now falls to the bottom of the cylinder 21 under its own weight, thereby holding the toilet seat 1 at a slightly forwardly inclined position in that raised condition. At this position, the by-pass valve 223 is held pressing against the bottom of the hydraulic cylinder 21 by the piston-cum-static weight 22 and thus closes the by-pass port 222 (as shown in actual line in FIG. 3). In operation, when the control valve 8 is pressed with foot, water will pass from the supply source through the pipe 41, valve 8 and pipe 42 into the cylinder 21, and in there the water will push the piston-cum-static weight 22 to rise. The by-pass valve 223, also under the actuating water pressure, now closes the by-pass port 222 throughout the period during the uplifting journey of the piston-cum-static weight 22. Following this uplifting movement water from the top of the piston-cum-static weight 22 is then released into the cistern 7 from the outlet 27 via the pipe 43. At this time, because the toilet seat 1 has been designed to be inclined slightly forwardly, it starts to descend under its own weight. Simultaneously, the actuating water also starts to push the piston-cum-static weight 22 to move upwardly. Since the falling speed of the toilet seat 1 is subjected to the action of the piston-cum-static weight 22, there will be no impact noises produced until the toilet seat 1 has fallen evenly on top of the bowl. The piston-cum-static weight 22 is now stopped from further ascending movement by a check ring 26 located at the upper edge of the cylinder 21 and stays at the position as designated by dotted line in FIG. 2. When the control valve 8 is released to shut off the actuating water, the hydraulic pressure originally accumulated on the lower side of the piston-cum-static weight 22 now escapes through the orifice 2231 and from the by-pass port 222 onto the upper side of the piston-cum-static weight 22, and there the pressure disappears. When the pressure force has equalized on the upper and lower sides of the piston-cum-static weight, the by-pass valve 223 starts to fall under its own weight and thereby opens the by-pass port 222, and only now will the piston-cum-static weight 22 start to descend under its own weight and positively raise the toilet seat. The difference in time depends on the size of the orifice 2231, however, there is sufficient time difference for the user from the moment he/she removes his/her foot from the control valve 8 to the moment the toilet seat starts to ascend. If necessary, however, in place of the control valve a conventional delay valve may be employed in order to prolong the time difference. Again, it will also do if the seal ring 224 is removed so that the by-pass valve 223 is not tightly sealed, to thereby substitute for the orifice 2231. For the reasons as stated above, during use of the toilet the by-pass valve 223 will remain open, but as long as the user sits on the toilet seat 1, the piston-cum-static weight 22 will definitely not fall. However, as soon as the user leaves the seat 1 after use of the toilet, the piston-cum-static weight 22 starts to exert pressure forcing the water under it to pass through the by-pass port 222 onto the upper surface of the piston-cum-static weight 22. Consequently, this piston-cum-static weight 22, shown in dotted line in the drawing, starts to descend and, at the end will return to its original position shown in actual line in the drawing.

The above device for raising and lowering the toilet seat may be separately adapted for use with a water closet, and in that case follow a conventional flushing mechanism. To avoid operation of the mechanism for flushing the toilet bowl by hand, however, a simple known flush-valve operating system 5 may be employed and here all that has to be done is to connect the system 5 to the piston-cum-static weight 22 to achieve a perfect linking-up of the two. It is to be noted, however, that the above arrangement must not be an absolute requirement. Nevertheless, as one example of uses in accordance with the invention, the construction and function of the flush valve operating system will be briefly described hereinbelow.

Figure 1A:
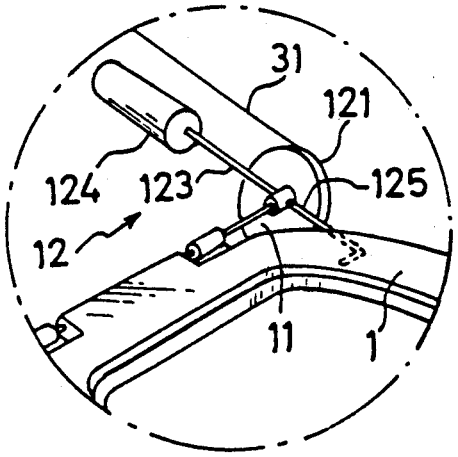
FIGS. 1A to 1C show three different embodiments of the connection at the pivotal axis of the toilet seat in FIG. 1.
Figure 1B:
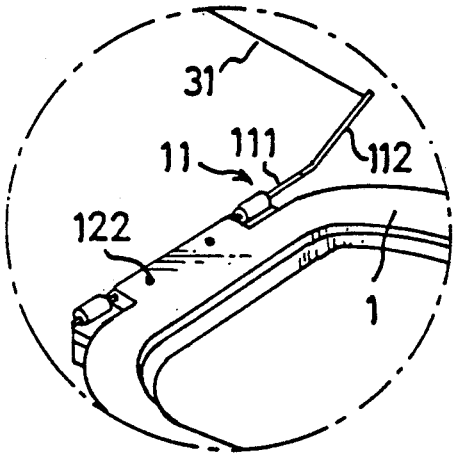
Figure 1C:
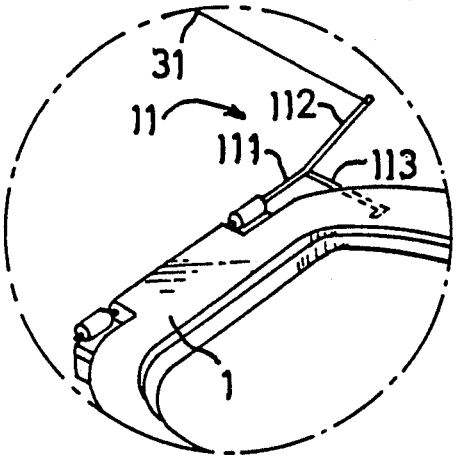
Figure 5:
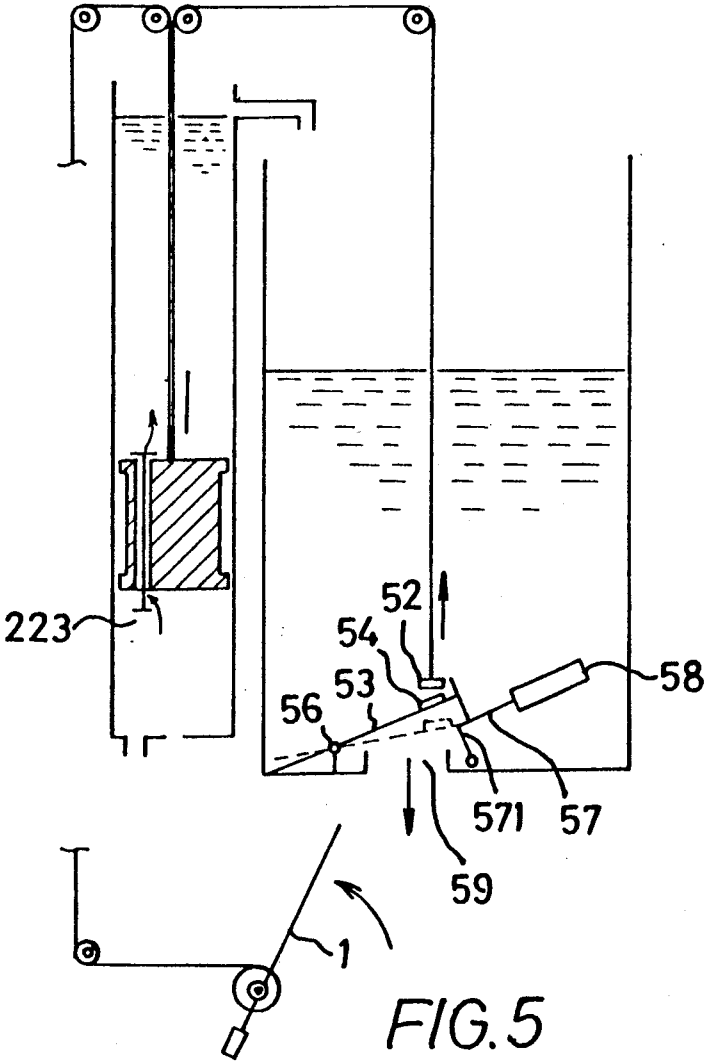
FIGS. 4 and 5 are schematic side views showing the actuation of the flush-valve opening system of the device.
Figure 4:
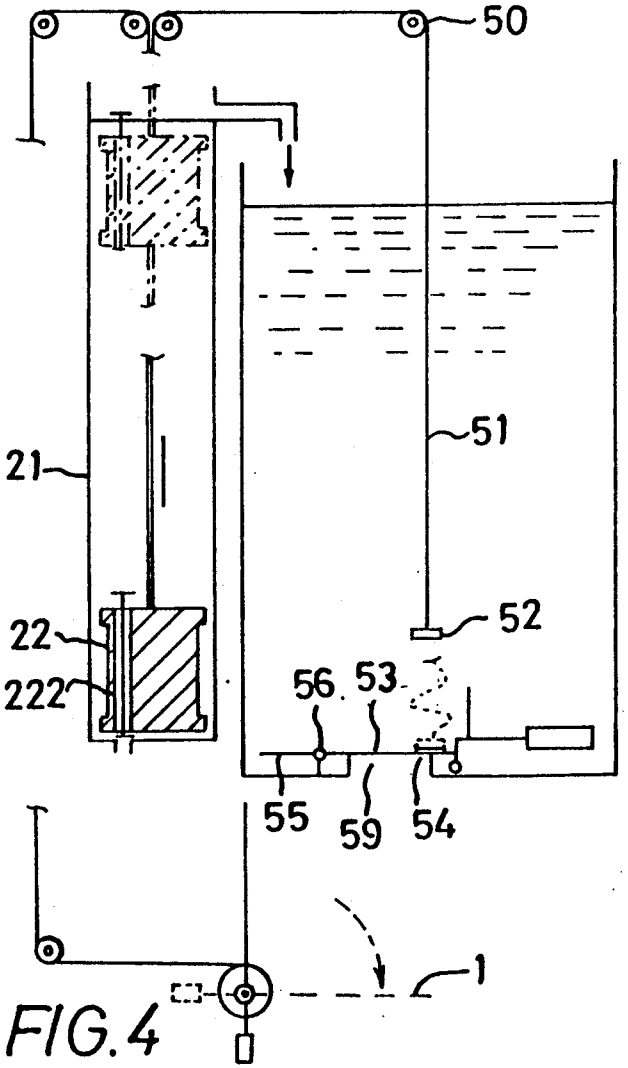

For the flush-valve operating system 5 of the present invention, the embodiment is as shown in FIGS. 1, 4 and 5, and comprises a suspension cord 51 having one end thereof connected to the piston 22 and the other end passing down from a pulley 50 to be suspended downwardly on the upper side of a flush valve 53 and provided at the terminal thereof with a magnetic secondary static weight 52, a magnet 54 mounted on the top of the flush valve 53 and opposite the secondary static weight 52, and a stop lever 55.

Function and operation of the flush-valve operating system 5 in the particular embodiment relative to the opening and closing of the flush valve part will now be described in detail as follows:

As shown in actual line in FIG. 4, the piston-cum-static weight 22 remains at the bottom of the cylinder 21 while the secondary static weight 52 hangs by the suspension cord 51, preferably a soft cord or a thin chain, at a higher position directly above the conventional flush valve 53. In this position, when a user intending to use the toilet steps on the control valve 8, the piston-cum-static weight 22, as described above, starts to rise and, at the same time, allows the toilet seat 1 to come down. Simultaneously, the secondary static weight 52, which hangs on the suspension cord 51, also starts to descend until it is attracted to the magnet 54 fixed on the flush valve 53. When the control valve 8 is released and the actuating water cut off, there is a considerable time difference from the period the by-pass valve 223, which is originally closed, opens up the by-pass port 222 to the period the piston-cum-static weight 22 starts to descend, and also the suspension cord 51, shown in dotted line in FIG. 4, has a considerable space motion interval. Therefore, the flush valve 53 will not open before the user has time to sit on the toilet seat 1. When the user has finished use and stands up from the toilet seat, due to the by-pass valve 223 which is now open, the piston-cum-static weight 22 is able to descend to be almost near the bottom of the cylinder 21. It is at this time only that the piston-cum-static weight 22 opens, by way of the secondary static weight 52 on the other end of the suspension cord 51 fastened to the upper side of the piston-cum-static weight 22 and the magnet 54, the flush valve 53 to flush the toilet bowl as shown in FIG. 5. The flush valve 53 opens up with the pivot 56 acting as the pivot point, and when the left end of the stop lever 55 touches the bottom plate of the cistern, the valve 53 is still kept open by the float stand shoulder. Here, the secondary static weight 52 continues to be pulled up by teh piston-cum-static weight 22 which is still in the process of lowering. By now, the toilet seat 1 has been raised to its almost vertical position, and the moment of force needed for the raising of the toilet seat 1 has also decreased. Therefore, the gravitational force of the piston-cum-static weight 22 is advantageous and helps the secondary static weight 52 to separate from the magnet 54. Subsequently, this piston-cum-static weight 22 falls down to the bottom of the cylinder and the secondary weight 52 also comes to stay at a slightly higher place directly above the magnet 54. Likewise, the flush valve 53 comes to be supported on a shoulder 571 of a control stand 57 in the open condition to continue flushing of the toilet bowl as shown in dotted line in the drawing. As the water level falls down in the cistern, the conventional water supply valve in the cistern starts to provide water (being a standard valve, the supply valve is not shown in the drawing). Water continues to flow in until the cistern is drained when, the float 58 loses its buoyancy and starts to fall down, thereby causing the flush valve 53 to be released from the control stand shoulder 571 and to close the flush port 59. At the end, the flush valve 53 is returned to its original position.

Although for urinating only there is no need for lowering of the toilet seat 1, in order to flush the toilet bowl, however, the user still has to press the control valve 8 with foot after use of the toilet. In other words, for evacuating bowels it is necessary that the control valve 8 is first pressed and for urinating purpose it requires only to press the control valve afterwards. In this way, the operation of the flush of the toilet bowl is accomplished according to the foregoing action.

From the foregoing, it is evident that the present invention has provided a combined toilet seat lifting and flush-valve opening mechanism whereby hand operation is replaced by a stamping action to control the automatic lowering of the toilet seat and the opening of the flush valve to flush the toilet bowl by water pressure actuation in cooperation with action of the gravitational force of the piston-cum-static weight. In the preferred embodiment of the invention, a second static weight is provided to share part of the weight function of the piston-cum-static weight in order to reduce the size of the hydraulic cylinder unit and facilitate its mounting on the inner side of the cistern without having to modify the outer appearance of the toilet apparatus. In the prior art, the additional gland provided on the bottom of the cistern where a piston rod is passed through likely results in friction, and this in turn will further weaken the descending function of the piston-cum-static weight. A soft cord used in place of the piston rod as the connecting unit eliminates all the drawbacks in the prior art and simplifies the construction with the attendant advantages of a reduction in the cost of production.

While a preferred embodiment of the invention has been shown and described, it will be apparent to those skilled in the art that various changes and modifications may be made therein without departing from the spirit and scope of the invention as claimed.

I claim:

1. An operating mechanism in a water closet having a toilet bowl, a cistern, a seat pivotally mounted on said toilet bowl for pivotal movement about a horizontal axis between a generally vertical position and a generally horizontal position and a flush valve for flushing fluid from said cistern to said toilet bowl, said operating mechanism comprising:

a hydraulic cylinder unit having a piston vertically moveably mounted therein;

a connecting means for connecting said piston with said seat such that downward movement of said piston in said hydraulic cylinder raises said seat and upward movement of said piston in said hydraulic cylinder lowers said seat;

a fluid pipeline connected to said hydraulic cylinder unit for providing fluid thereto for moving said piston upward in said hydraulic cylinder; and a control valve in said fluid pipeline for admitting fluid through said fluid pipeline to move said piston upward in said hydraulic cylinder under fluid pressure to lower said seat onto said toilet bowl and for closing off fluid from said fluid pipeline;

wherein said piston has a through hole extending from one side thereof to the other and a bypass valve regulating fluid flow through said through hole.

2. The operating mechanism of claim 1, wherein said hydraulic cylinder is mounted inside said cistern, said fluid pipeline is connected to the lower end of said hydraulic cylinder, and a fluid supply is connected to said fluid pipeline.

3. The operating mechanism of claim 1, wherein:

said hydraulic cylinder is mounted adjacent to said cistern;

an inlet is provided at the lower end of said hydraulic cylinder unit and is connected to said fluid pipeline; and an outlet is provided at the upper end of said hydraulic cylinder unit and has a pipe communicating with said cistern.

4. The operating mechanism of claim 1, wherein said piston means comprises a piston having a weight for moving said piston downward in said hydraulic cylinder.

5. An operating mechanism in a water closet having a toilet bowl, a cistern, a seat pivotally mounted on said toilet bowl for pivotal movement about a horizontal axis between a generally vertical position and a generally horizontal position and a flush valve for flushing fluid from said cistern to said toilet bowl, said operating mechanism comprising:

a hydraulic cylinder unit having a piston vertically moveably mounted therein;

a connecting means for connecting said piston with said seat such that downward movement of said piston in said hydraulic cylinder raises said seat and upward movement of said piston in said hydraulic cylinder lowers said seat;

a fluid pipeline connected to said hydraulic cylinder unit for providing fluid thereto for moving said piston upward in said hydraulic cylinder; and a control valve in said fluid pipeline for admitting fluid through said fluid pipeline to move said piston upward in said hydraulic cylinder under fluid pressure to lower said seat onto said toilet bowl and for closing off fluid from said fluid pipeline;

wherein said connecting means comprises an operating lever mounted on said horizontal axis of said seat and a static weight connected to said operating lever for counterbalancing pivotal movement of said seat.

6. An operating mechanism in a water closet having a toilet bowl, a cistern, a seat pivotally mounted on said toilet bowl for pivotal movement about a horizontal axis between a generally vertical position and a generally horizontal position and a flush valve for flushing fluid from said cistern to said toilet bowl, said operating mechanism comprising:

a hydraulic cylinder unit having a piston vertically moveably mounted therein;

a connecting means for connecting said piston with said seat such that downward movement of said piston in said hydraulic cylinder raises said seat and upward movement of said piston in said hydraulic cylinder lowers said seat;

a fluid pipeline connected to said hydraulic cylinder unit for providing fluid thereto for moving said piston upward in said hydraulic cylinder; and a control valve in said fluid pipeline for admitting fluid through said fluid pipeline to move said piston upward in said hydraulic cylinder under fluid pressure to lower said seat onto said toilet bowl and for closing off fluid from said fluid pipeline; and a flush-valve opening means for opening said flush valve upon downward movement of said piston means in said hydraulic cylinder, said flush valve opening means comprising a suspension cord having one end connected to said piston means, a plurality of guide pulleys upon which said suspension cord is guided, the other end of said suspension cord being suspended above said flush valve, a static weight connected to said other end of said suspension cord, a magnet on the upper side of said flush valve for attracting said static weight, and a stop lever on said flush valve on a portion thereof opposite said magnet for stopping opening movement of said flush valve.

7. A toilet-seat flush-valve operating device in a water closet having a toilet bowl, a cistern, a toilet seat pivotally mounted on said toilet bowl for pivotal movement about a horizontal axis between a generally vertical position and a generally horizontal position and a flush valve for flushing fluid from said cistern to said toilet bowl, said toilet-seat flush-valve operating device comprising:

a hydraulic cylinder unit having a piston means for moving under a working fluid pressure and storing potential energy in said hydraulic cylinder unit, said piston means comprising a piston moveably mounted in said hydraulic cylinder;

a toilet-seat operating lever unit connected to said toilet seat for pivotal movement thereof about the horizontal axis;

a connecting means for connecting said piston means with said toilet-seat operating lever unit for pivotal movement of said toilet seat in response to movement of said piston means in said hydraulic cylinder unit;

a flush-valve opening means for opening said flush valve to flush fluid from said cistern to said toilet bowl in response to movement of said piston means in said hydraulic cylinder unit, said flush-valve opening means comprising a cord having one end connected to said piston means, with the other end having a means for engaging said flush-valve;

a fluid pipeline having one end connected to a working fluid supply and the other end to said hydraulic cylinder unit for supplying working fluid thereto for moving said piston means in said hydraulic cylinder unit; and a control valve in said fluid pipeline for supplying and cutting off the working fluid to said hydraulic cylinder unit, whereby opening of said control valve causes working fluid to be supplied to said hydraulic cylinder unit to move said piston means in said hydraulic cylinder unit, lower said toilet-seat under its own weight through said connecting means and said toilet-seat operating lever unit, store potential energy from the lowering of said toilet-seat and the working fluid, and cause said means for engaging of said cord to engage said flush-valve, and whereby closing of said control valve causes working fluid to be cut-off from said hydraulic cylinder unit and said piston means to move under the force of the stored potential energy so that said toilet-seat is raised by said connecting means and said toilet-seat operating lever unit and said flush-valve is opened by said cord having said means for engaging said flush-valve.

8. The toilet-seat flush-valve operating device of claim 7, wherein said piston means comprises a passage allowing the working fluid to flow from one side of said piston to the other.

9. The toilet-seat flush-valve operating device of claim 7, wherein said toilet-seat operating lever unit has a static weight mounted thereon counterbalancing said toilet-seat.

10. The toilet-seat flush-valve operating device of claim 7, wherein said means for engaging said flush valve comprises a magnetic static weight suspended on said other end of said cord, with said flush-valve having a magnetic fixed stator mounted thereto.

11. The toilet-seat flush-valve operating device of claim 7, wherein said toilet-seat operating lever unit comprises a horizontal L-shaped pivotal member disposed along the pivot axis of said toilet-seat.

12. The toilet-seat flush-valve operating device of claim 7, wherein said toilet-seat operating lever unit comprises an operating wheel, said connecting means being connected to said operating wheel.

* * * * *